US006023908A

United States Patent [19]

Vetsch

[11] Patent Number: 6,023,908

[45] Date of Patent: Feb. 15, 2000

[54] METHOD AND APPARATUS FOR FOLDING A NAPKIN AROUND AN EATING UTENSIL

[76] Inventor: Kevin R. Vetsch, 1306 NW. 63rd Ter., Kansas City, Mo. 64118

[21] Appl. No.: 08/864,014

[22] Filed: May 27, 1997

[51] Int. Cl.[7] ..... B65B 35/54; B65B 11/04

[52] U.S. Cl. ..... 53/155; 53/211; 53/215; 53/216

[58] Field of Search ..... 53/461, 465, 397, 53/444, 445, 148, 155, 211, 215, 216, 219, 213

[56] References Cited

U.S. PATENT DOCUMENTS

| | | | |
|---|---|---|---|
| 1,075,684 | 10/1913 | Baur | 53/219 |
| 2,391,125 | 12/1945 | Carpenter | 53/155 X |
| 2,608,810 | 9/1952 | Smathers | 53/213 |
| 3,164,937 | 1/1965 | Ingram . | |
| 4,313,288 | 2/1982 | Tassi et al. . | |
| 4,466,227 | 8/1984 | Hanscom . | |
| 4,773,202 | 9/1988 | Felts et al. . | |
| 5,117,928 | 6/1992 | Weihe | 209/926 |
| 5,237,801 | 8/1993 | Hillam et al. | 53/446 |
| 5,469,688 | 11/1995 | Dunbar et al. | 53/461 X |

*Primary Examiner*—Linda Johnson
*Attorney, Agent, or Firm*—Kenneth L Tolar

[57] ABSTRACT

The present invention relates to a method and apparatus for rolling a napkin around silverware. The device comprises a housing having a conveyor belt system for advancing a napkin therethrough along a substantially horizontal path. As the napkin traverses said path, it contacts a folding belt which causes a corner of the napkin to be folded back onto itself. A knife, fork or other piece of silverware is delivered from storage bins in timed relation to the movement of the napkin to ensure placement thereon. The napkin and silverware then contact a rapidly moving rolling belt which rolls the napkin around the silverware. The rolled napkin and silverware are then transported out of the housing and on to an external holding bin.

19 Claims, 3 Drawing Sheets

METHOD AND APPARATUS FOR FOLDING A NAPKIN AROUND AN EATING UTENSIL

BACKGROUND OF THE INVENTION

The present invention relates to a method and apparatus for folding napkins around a knife, fork or other eating utensil. The device comprises a hollow housing which has a plurality of rollers therein. The rollers support a conveyor-type drive belt that defines a substantially horizontal path as well as a folding belt and a rolling belt all of which are synchronously propelled by rotating a hand crank. The hand crank is attached to a larger diameter roller which is in synchronous communication with the others using chains or belts. The conveyor type belt transports a napkin through the device where a first belt folds a corner of the napkin.

Knives and forks are stored in separate holding bins located on the top exterior of the housing. Each bin has an aperture on its bottom surface allowing it to be in communication with the interior of the hollow housing. The aperture is covered by a trap door mechanism. As a corner folded napkin moves through the system on the drive belt, a pair of sprockets which are also being rotated by the hand crank, engage the trap doors, automatically releasing a knife and fork; the knife and fork one by one fall between the sprockets and onto the top surface of the napkin located below. The napkin and silverware then contact a rapidly moving belt that rolls the napkin about the knife and fork. Once the napkin is rolled, it is automatically deposited into an external holding bin.

DESCRIPTION OF THE PRIOR ART

Devices for packaging and wrapping certain items are generally known in the prior art. However, none of these devices are capable of rolling silverware within a napkin. Therefore it is an object of this invention to provide a method and device for quickly and easily rolling a desired quantity of napkins around various pieces of silverware.

U.S. Pat. No. 3,164,937 issued to Ingram relates to a wrapping machine that heat seals the wrapping material.

U.S. Pat. No. 4,313,288 issued to Tassi, et al. discloses a machine for packaging articles between two weldable plastic sheets.

U.S. Pat. No. 4,466,227 issued to Hanscom relates to a machine for wrapping tape about an article.

U.S. Pat. No. 4,773,202 issued to Felts, et al. discloses a method and apparatus for packaging and folding newspapers. As indicated above, none of the described inventions disclose a device that is capable of rolling napkins around knives, forks and other similar silverware.

SUMMARY OF THE INVENTION

Restaurants and other commercial eating establishments roll silverware such as knives, forks and spoons within napkins and place them on a table. The practice generally enhances the table decor and provides a convenient method for preparing a table in advance of customers actually being seated. In addition, self service cafeterias often roll a substantial number of napkins and silverware and place them in a bin for customers to select upon entering a food line. Currently, a napkin must be rolled around silverware one by one, by hand, usually by a waiter, waitress or other restaurant or food service employee. Such a practice is not only tedious but time consuming, inefficient and costly in terms of manpower hours. Therefore, there is currently a need for a device that can simplify, expedite and streamline this process.

The present invention relates to a method and machine capable of continuously rolling a substantial number of napkins around silverware. It is therefore an object of the present invention to provide a simple and inexpensive folding system for napkins and silverware.

It is yet another object of the present invention to provide an apparatus that can quickly and easily roll napkins around silverware continuously in an assembly line type fashion.

It is yet another object of the present invention to provide an apparatus for rolling napkins around silverware that is powered by a hand-crank, giving the user more control over the process.

It is yet another object of the present invention to provide a device for rolling napkins that is capable of storing a substantial number of knives, forks spoons, or other silverware therein.

It is yet another object of the present invention to provide a device for rolling napkins around silverware that is capable of receiving and storing a substantial number of rolled napkins and silverware therein.

It is yet another object of the present invention to provide a device for rolling napkins that is capable of selectively delivering a knife, fork or other eating utensil, one by one, to the top surface of a napkin. Other objects, features and advantages of the present invention, its details of construction and arrangement of parts will be seen from the following description of the preferred embodiments when considered with the attached drawings and from the appended claims.

DESCRIPTION OF THE PREFERRED EMBODIMENT

Figure 2:
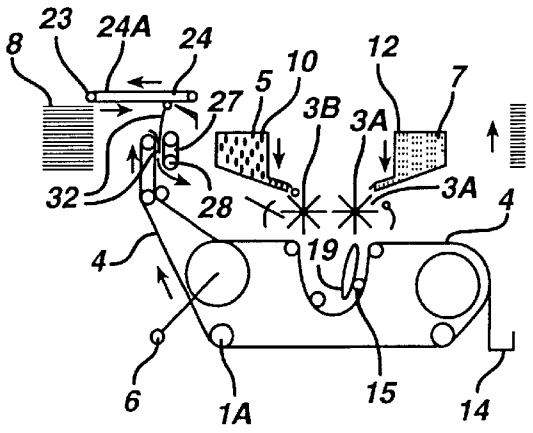
FIG. 2 depicts the interior components of the device, primarily the folding and rolling belts and associated rollers.
Figure 1:
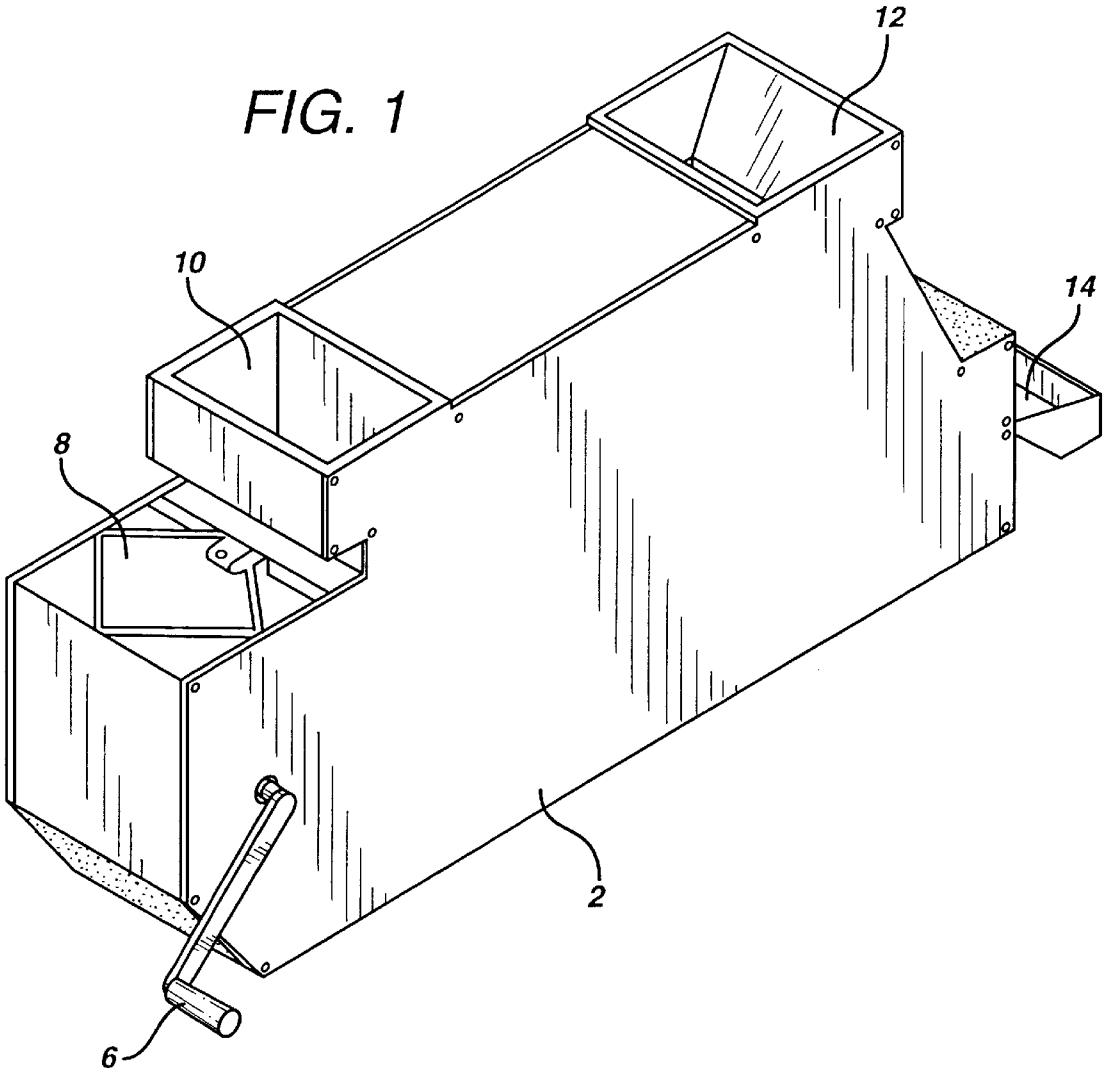
FIG. 1 depicts a top view of the exterior of the device and knife and fork holding bins.

Referring now to FIGS. 1–5, the invention generally relates to a device for folding and rolling napkins 8 around various pieces of silverware. The preferred embodiment comprises a substantially rectangular box-shaped, hollow housing 2. The hollow portion of the housing 2 defines an interior chamber. The housing 2 has two ends, an inlet, an outlet and a top exterior.

The preferred embodiment has a pair of bins 10,12 resting on the top exterior of the hollow housing 2. The bins store knives 5 and forks 7 therein. As can be seen by anyone skilled in the art to which this invention applies, the bins 10, 12 may receive and store other pieces of silverware as well such as a spoon, teaspoon, etc. Each bin 10, 12 is a substantially hollow, box-shaped compartment having an angled bottom 26 that is tapered toward an aperture. Each aperture is covered by a spring loaded trap door 30. When the trap doors 30 are open, the bins 10, 12 are in communication with the interior chamber of the housing 2. The angled bottom 26/trap door mechanism 30 is important for allowing a knife 5, fork 7 or other piece of silverware to exit the bins smoothly without jamming.

Figure 3:
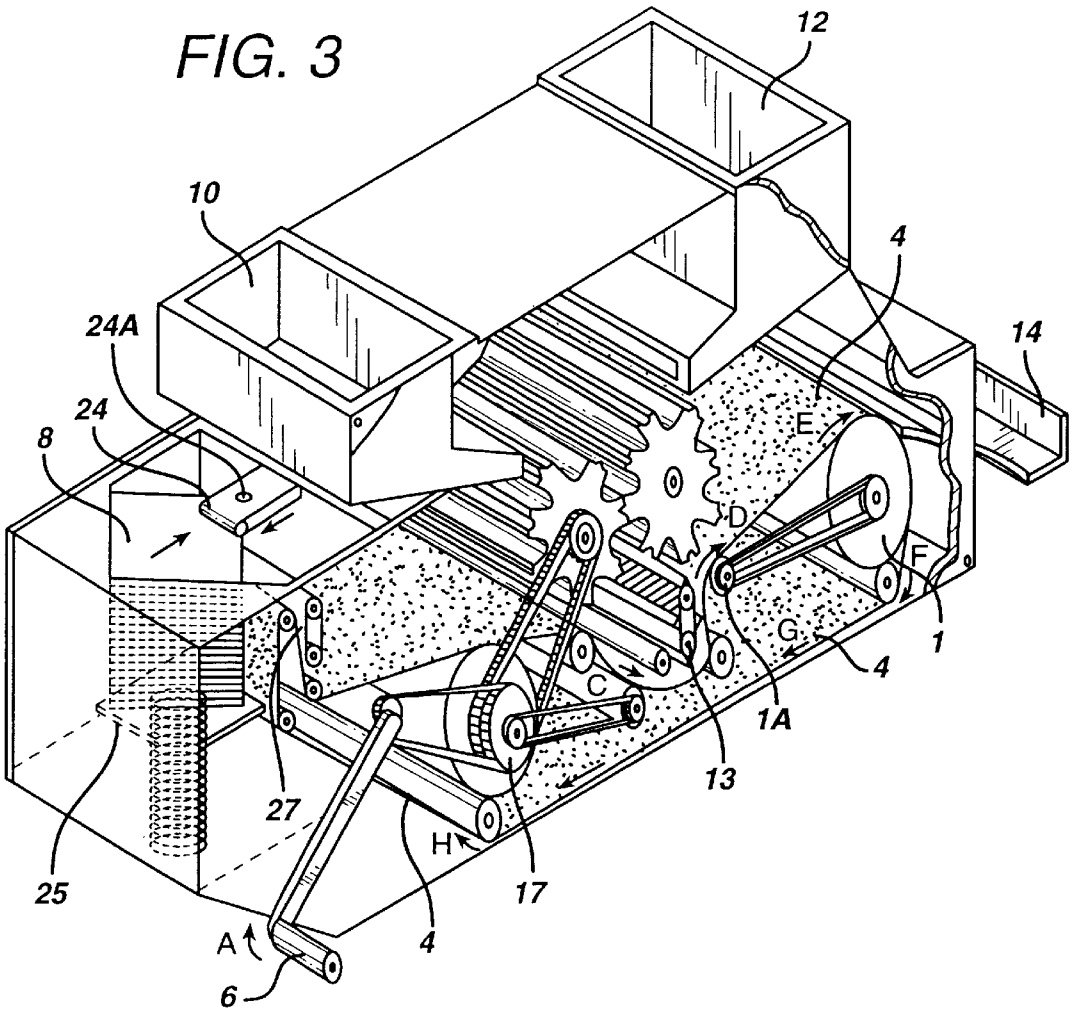
FIG. 3 is a cross-sectional view of the device showing the interior components.

Referring now to FIGS. 2 and 3, received within the interior chamber of the housing 2 are a plurality of interacting drive belt rollers 1. At least one of the rollers 1 has a larger relative diameter with respect to the remainder. One of the larger diameter rollers 1 accompanies a hand crank 6 for rotating the rollers and powering the system as detailed below. The smaller diameter rollers 1A are idler rollers. The rollers 1 rotatably engage a continuous conveyor type drive belt 4 having a predetermined width. The drive belt 4 functions as a transport means for moving a napkin 8 through the device along a substantially horizontal predetermined path. The drive belt rollers 1 and idler rollers 1A are selectively placed so that the drive belt 4 sags downwardly at a substantially central position along the horizontal path. This causes a napkin being transported along said horizontal path to move briefly in a downward, substantially vertical direction and then briefly in an upward, substantially vertical direction. The purpose of the directional changes will become apparent from the description below.

Figure 5:
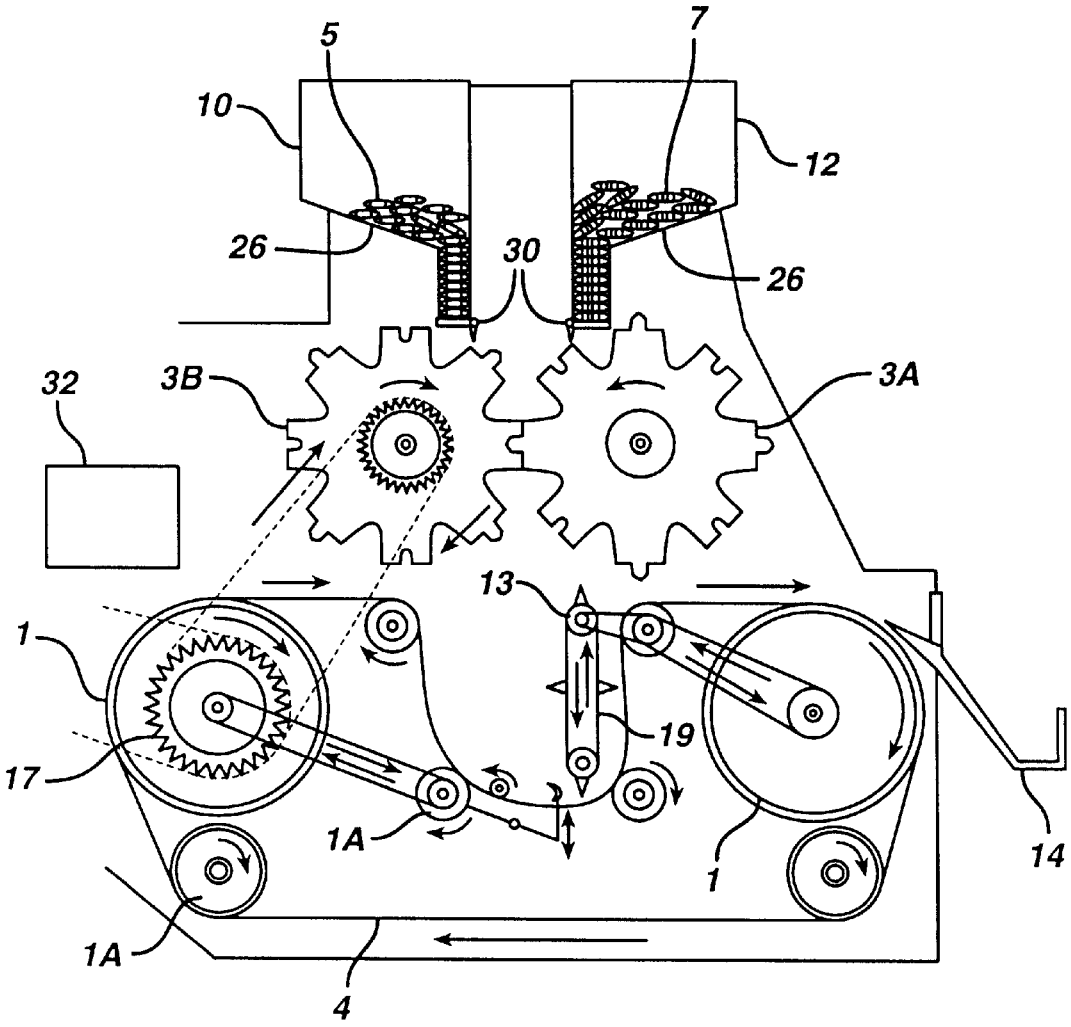
FIG. 5 depicts a side view of the housing contents including the silverware bins and associated trap doors.

Received within the housing 2 and directly above the sagging portion are a pair of mutually engaging, elongated sprockets 3A, 3B having a plurality of longitudinal protrusions radially extending therefrom as depicted in FIG. 5. The sprockets 3A, 3B also have a plurality of longitudinal, radially mounted slots between said protrusions for receiving a corresponding protrusion from the mutually engaging sprocket. Alternating the relative position of a protrusion with respect to a protrusion on the other sprocket results in the two trap doors 30 being opened at alternating intervals to prevent the silverware from jamming. The mating positioning of the protrusions and slots also allow the sprockets 3A, 3B to mutually rotate in opposite directions. The diameter of the sprockets and the distance between the protrusions are designed such that a knife 5 or fork 7 is released and dropped only when a napkin is in the sagging portion of the belt as described in more detail below.

Figure 4:
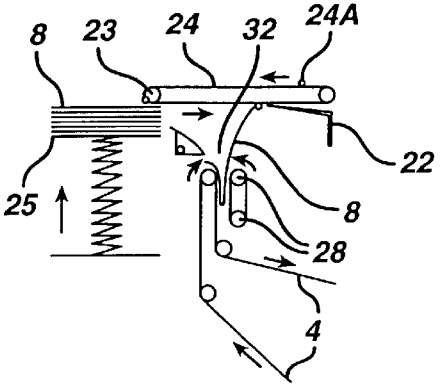
FIG. 4 shows the napkin selector belt with its associated disconnect rod and a napkin being transported through the device.

Proximal to a first end of the housing is a spring loaded platform 25 on which napkins 8 are stacked in a catty-corner fashion so that a corner of a napkin is adjacent to the first end of the housing 2. At the same end of the housing 2 are a pair of smaller diameter rollers 23 around which is a substantially horizontal napkin selector belt 24 having an upper surface as shown in FIG. 4. The napkin selector belt 24 also has a plurality of Velcro® patches 24A or similar attachment means on its upper surface. The belt 24 and rollers 23 are placed in close proximity to the stack of napkins so that the Velcro® patches 24A can contact the adjacent corner of a napkin 8 resting on the platform 25. The spring loaded platform 25 allows the stack of napkins 8 to move upward and continue contacting the patches 24A as the number of napkins 8, and thus the height and weight of the stack, is diminished.

Received within the interior chamber of the housing 2 just below the napkin selector belt 24 are another pair of smaller diameter rollers 28 around which is a another substantially vertical folding belt 27. This belt 27 is placed proximal to an upper corner of the housing 2 and near the drive belt 4. The area between the substantially vertical folding belt 27 and the drive belt 4 forms a folding section 32. A corner of a napkin 8 is grabbed by the napkin selector belt 24 and an opposite corner of the napkin drops into the folding section 32. The vertical folding belt 27 causes the corner of the napkin to be folded back onto the napkin resulting in a corner fold as illustrated in FIG. 2.

A napkin disconnect rod 22 is placed at a predetermined position within the housing proximal to the napkin selector belt 24. The disconnect rod 22 engages and grabs the napkin removing it from the Velcro® patches 24A. The position of the napkin disconnect rod 22 with respect to the napkin belt 24 determines the size of the corner fold. The location of the disconnect rod 22 may be adjusted as desired to achieve the desired corner fold size.

Another pair of rollers 13 are placed within the sagging portion of the drive belt. A rolling belt 19 is wrapped around and engages the rollers 13, the area between the belt 19 and the drive belt 4 defining a rolling section 15. The rolling belt 19 is substantially vertical but is preferably placed at somewhat of an angle to the vertical plane and substantially parallel to the substantially vertical portion of the conveyor belt 4 defining the vertically upward portion of the substantially horizontal path. A deposit tray 14 is attached to the housing at a second end opposite the napkin platform 25 for receiving rolled napkins.

The drive belt 4, folding belt 27, rolling belt 19, napkin selector belt 24 and silverware delivering sprockets 3A, 3B are powered and rotated by a hand-crank 6. The hand-crank 6 is attached to one of the rollers 1, preferably a larger diameter roller as shown in FIG. 2. The roller 1 is interrelated with each of the other rollers 1, 13, 28 by a series of chains or belts, as depicted in phantom in FIG. 5, which engage drive sprockets transmissions 17 placed on an end of one or more rollers. A belt or chain is also attached to a drive sprocket transmission on an end of one of the sprockets 3A or 3B so that each of the rollers 1, 13, 28 and the sprockets 3A, 3B rotate in synchronicity whenever the hand crank 6 is rotated.

Using the device as described above, a napkin 8 may be folded around a knife 5, fork 7 or other eating utensil as follows. A stack of napkins 8 are placed on the napkin supply platform 25 with a corner adjacent to the housing inlet at the first end of said housing. The user begins rotating the hand-crank 6 in a clockwise direction. The napkin selector belt 24 begins to move in a counter-clockwise direction. One of the Velcro® patches 24A attaches to a corner of a napkin 8 and transports it into the housing 2 inlet and into the folding section 32. An opposite corner of a napkin 8 then engages the drive belt 4 and the folding belt 27 causing the corner to be folded back onto the napkin 8 as illustrated in FIG. 2. Once a corner of the napkin is folded, the napkin engages the napkin disconnect rod 22 causing the napkin to release from the Velcro® patches 24A.

The corner folded napkin then rests on the drive belt 4 where it is transported to the sagging area. Meanwhile, the silverware feeding sprockets, 3A,3B have begun reciprocally rotating as well. A protrusion on each of the feeder sprockets 3A, 3B alternately engages a spring loaded trap door 30 on each of the silverware bins 10, 12 allowing a single knife 5, fork 7 or other piece of silverware one by one to be dropped on the top exterior of the corner folded napkin 8. The protrusions are alternated with respect to the protrusions on the other sprocket so that a knife and fork are not released from their respective bins 10, 12 at the same time and so that the sprockets 3A, 3B can freely rotate with respect to each other.

The corner folded napkin 8 having a knife 5 and fork 7 thereon is then transported to the rolling area where it begins to move upwardly along the vertical, sagging portion of the path. Simultaneously, the napkin and silverware are engaging the rolling belt 19. The rollers advancing the rolling belt 19 are of relatively smaller diameter than and are directly in communication with one of the larger diameter drive rollers 1. This results in the rolling belt 19 moving at a substantially higher linear speed than the drive belt 4. By simultaneously engaging the main belt 4 and the faster moving rolling belt 19, the napkin 8 is rolled back on itself until the entire napkin is rolled about the knife, fork or other silverware. The rolled knife and fork continue moving with the drive belt until they exit the housing and are deposited onto the folded silverware deposit tray 14. From the above description, it is now apparent that the new invention provides a method and apparatus for folding a napkin around a knife, fork, spoon or other eating utensil. It is understood that although there has been shown and described the preferred embodiment of the described invention, that modifications may be made to the invention which do not exceed the scope of the appended claims. Accordingly, the scope of my invention is to be limited only by the following claims:

I claim:

1. An apparatus for folding a napkin around one or more pieces of silverware comprising:

a conveyor means for transporting a napkin along a substantially horizontal, predetermined path;

means for advancing the conveyor means in a substantially horizontal direction;

means for placing a napkin on said conveyor means, said napkin placing means including a plurality of rollers proximal to said first end of said housing, a continuous, substantially horizontal belt having an exterior surface, surrounding and engaging said rollers, a napkin platform proximal to said horizontal belt to allow a napkin stacked thereon to be in selective contact therewith, an attachment means on the exterior surface of said belt for retreiving a napkin from said platform and placing it on said belt upon said attachment means contacting said napkin, and means for moving said belt in synchronous fashion with respect to said conveyor means;

means for rolling a napkin about said silverware;

means for folding a corner of a napkin back onto itself prior to rolling said napkin;

means for selectively depositing a piece of silverware on said napkin in timed relation to movement of the napkin along the predetermined path so that the silverware fall onto a napkin as opposed to the conveyor means;

a hollow housing having an interior chamber for receiving and transporting said conveyor means and said rolling means, said housing having first and second ends, an inlet, for receiving a napkin, an outlet through which silverware and a napkin rolled therearound are delivered and a top exterior on which said silverware placing means is disposed.

2. An apparatus according to claim 1 further comprising:

a plurality of silverware storage bins, integral with the top exterior of said housing, each having a downwardly sloping bottom surface that terminates at an aperture;

a spring loaded trap door attached to each of said storage bins and covering said apertures, said trap doors manually and intermittently openable in synchronous relationship with said conveyor means; said apertures being in communication with the interior chamber of said housing when said trap doors are in an open position.

3. An apparatus according to claim 1 further comprising means for receiving and storing a rolled napkin.

4. An apparatus according to claim 2 wherein said means for selectively depositing a piece of silverware onto said napkin comprises:

a pair of mutually engaging sprockets received within the interior chamber of said housing, disposed above said sagging portion of said drive belt and adjacent said trap doors, each having radially mounted, longitudinally extending protrusions for alternately engaging said trap doors;

means for reciprocally rotating said sprockets in a synchronous fashion with respect to said conveyor means whereby the protrusions alternately engage and open said trap doors.

5. An apparatus according to claim 4 wherein said means for reciprocally rotating said sprockets comprises:

a belt means rotatably attached to a sprocket and said conveyor advancing means;

said sprockets having a plurality of radial, longitudinal slots between said protrusions, said slots on a sprocket each receiving a protrusion from an engaging sprocket whereby rotation of one sprocket in one direction causes the engaging sprocket to rotate in an opposite direction.

6. An apparatus according to claim 1 wherein said attachment means includes a hook and loop fastener.

7. An apparatus for folding a napkin around one or more pieces of silverware comprising:

a conveyor means for transporting a napkin along a substantially horizontal, predetermined path, said conveyor means comprising a plurality of idler rollers, a plurality of drive rollers, a continuous conveyor belt having a lower surface encompassing and engaging said idler and drive rollers and an upper surface on which said napkin is placed, said idler and drive rollers selectively placed to cause the conveyor belt to extend downwardly and upwardly at a central position along the horizontal path to form a sagging section;

means for advancing said conveyor means in a substantially horizontal direction;

means for placing a napkin on said conveyor means;

means for rolling a napkin about said silverware;

means for folding a corner of a napkin back onto itself prior to rolling said napkin, said napkin folding means including a plurality of rollers proximal the upper surface of said conveyor belt, a folding belt surrounding and engaging said rollers, and means for advancing said folding belt in synchronous relationship with said conveyor means and means for selectively depositing a piece of silverware on said napkin in timed relation to movement of the napkin along the predetermined path so that the silverware fall onto a napkin as opposed to the conveyor means;

a hollow housing having an interior chamber for receiving and transporting said conveyor means and said rolling means, said housing having first and second ends, an inlet, for receiving a napkin, an outlet through which silverware and a napkin rolled therearound are delivered and a top exterior on which said silverware placing means is disposed.

8. An apparatus according to claim 7 further comprising:

a plurality of silverware storage bins, integral with the top exterior of said housing, each having a downwardly sloping bottom surface that terminates at an aperture;

a spring loaded trap door attached to each of said storage bins and covering said apertures, said trap doors manually and intermittently openable in synchronous relationship with said conveyor means; said apertures being in communication with the interior chamber of said housing when said trap doors are in an open position.

9. An apparatus according to claim 7 further comprising means for receiving and storing a rolled napkin.

10. An apparatus according to claim 7 wherein said means for rolling a napkin comprises:

a plurality of rollers having a smaller diameter than said drive rollers, proximal the upper surface of said conveyor belt and contained within the sagging section;

a rolling belt surrounding and engaging said rollers;

means for rotating said rollers and moving said belt in a synchronous fashion with respect to said drive rollers and said conveyor belt.

11. An apparatus according to claim 7 wherein said means for advancing the conveyor means along a horizontal path comprises a hand crank attached to a drive roller.

12. An apparatus according to claim 8 wherein said means for selectively depositing a piece of silverware onto said napkin comprises:

a pair of mutually engaging sprockets received within the interior chamber of said housing, disposed above said sagging portion of said drive belt and adjacent said trap doors, each having radially mounted, longitudinally extending protrusions for alternately engaging said trap doors;

means for reciprocally rotating said sprockets in a synchronous fashion with respect to said conveyor means whereby the protrusions alternately engage and open said trap doors.

13. An apparatus according to claim 12 wherein said means for reciprocally rotating said sprockets comprises:

a belt means rotatably attached to a sprocket and said conveyor advancing means;

said sprockets having a plurality of radial, longitudinal slots between said protrusions, said slots on a sprocket each receiving a protrusion from an engaging sprocket whereby rotation of one sprocket in one direction causes the engaging sprocket to rotate in an opposite direction.

14. An apparatus for folding a napkin around one or more pieces of silverware comprising:

a conveyor means for transporting a napkin along a substantially horizontal, predetermined path, said conveyor means comprising a plurality of idler rollers, a plurality of drive rollers, a continuous conveyor belt having a lower surface encompassing and engaging said idler and drive rollers and an upper surface on which said napkin is placed, said idler and drive rollers selectively placed to cause the conveyor belt to extend downwardly and upwardly at a central position along the horizontal path to form a sagging section;

means for advancing said conveyor means in a substantially horizontal direction;

means for placing a napkin on said conveyor means;

means for rolling a napkin about said silverware, said napkin rolling means including a plurality of rollers having a smaller diameter than said drive rollers, proximal the upper surface of said conveyor belt and contained within the sagging section, a rolling belt surrounding and engaging said rollers, and means for rotating said rollers and moving said belt in a synchronous fashion with respect to said drive rollers and said conveyor belt;

means for folding a corner of a napkin back onto itself prior to rolling said napkin;

means for selectively depositing a piece of silverware on said napkin in timed relation to movement of the napkin along the predetermined path so that the silverware fall onto a napkin as opposed to the conveyor means;

a hollow housing having an interior chamber for receiving and transporting said conveyor means and said rolling means, said housing having first and second ends, an inlet, for receiving a napkin, an outlet through which silverware and a napkin rolled therearound are delivered and a top exterior on which said silverware placing means is disposed.

15. An apparatus according to claim 14 further comprising:

a plurality of silverware storage bins, integral with the top exterior of said housing, each having a downwardly sloping bottom surface that terminates at an aperture;

a spring loaded trap door attached to each of said storage bins and covering said apertures, said trap doors manually and intermittently openable in synchronous relationship with said conveyor means; said apertures being in communication with the interior chamber of said housing when said trap doors are in an open position.

16. An apparatus according to claim 14 further comprising means for receiving and storing a rolled napkin.

17. An apparatus according to claim 14 wherein said means for advancing the conveyor means along a horizontal path comprises a hand crank attached to a drive roller.

18. An apparatus according to claim 15 wherein said means for selectively depositing a piece of silverware onto said napkin comprises:

a pair of mutually engaging sprockets received within the interior chamber of said housing, disposed above said sagging portion of said drive belt and adjacent said trap doors, each having radially mounted, longitudinally extending protrusions for alternately engaging said trap doors;

means for reciprocally rotating said sprockets in a synchronous fashion with respect to said conveyor means whereby the protrusions alternately engage and open said trap doors.

19. An apparatus according to claim 18 wherein said means for reciprocally rotating said sprockets comprises:

a belt means rotatably attached to a sprocket and said conveyor advancing means;

said sprockets having a plurality of radial, longitudinal slots between said protrusions, said slots on a sprocket each receiving a protrusion from an engaging sprocket whereby rotation of one sprocket in one direction causes the engaging sprocket to rotate in an opposite direction.

* * * * *